United States Patent [19]

D'Ath

[11] Patent Number: 4,475,753

[45] Date of Patent: Oct. 9, 1984

[54] SAFETY DOOR LOCK

[76] Inventor: Philip O. D'Ath, 4146 Melrose St., Apt. 14, Riverside, Calif. 92504

[21] Appl. No.: 313,181

[22] Filed: Oct. 20, 1981

[51] Int. Cl.[3] ..... E05C 17/16

[52] U.S. Cl. ..... 292/268

[58] Field of Search ..... 292/268, 269, 270, 265, 292/271

[56] References Cited

U.S. PATENT DOCUMENTS 1,287,978 12/1918 Harlev, Jr. ..... 292/268
1,596,183 8/1926 Horlick, Jr. ..... 292/268 X

FOREIGN PATENT DOCUMENTS 504474 4/1939 United Kingdom ..... 292/268

*Primary Examiner*—Richard E. Moore
*Attorney, Agent, or Firm*—Harvey B. Jacobson

[57] ABSTRACT

A latch member is mounted on the free swinging edge of a door and a mount is supported from a door frame toward which the door free swinging edge is moved to the closed position. The mount is supported for oscillation about an axis paralleling the door frame portion and an elongated hasp has one end pivotally supported from the mount for oscillation about an axis normal to the axis of oscillation of the mount and the other end of the hasp includes structure for latchingly engaging the latch member. In addition, the latch member is supported from a door edge mounted support and the longitudinal mid portion of the hasp and the mount include co-acting structure operable to interlockingly engage with each other and lock the door in the closed position. The hasp, when the end thereof remote from the mount is engaged with the latch member, is operative to allow slight movement of the associated door toward the open position and to prevent the door from being further opened.

8 Claims, 7 Drawing Figures

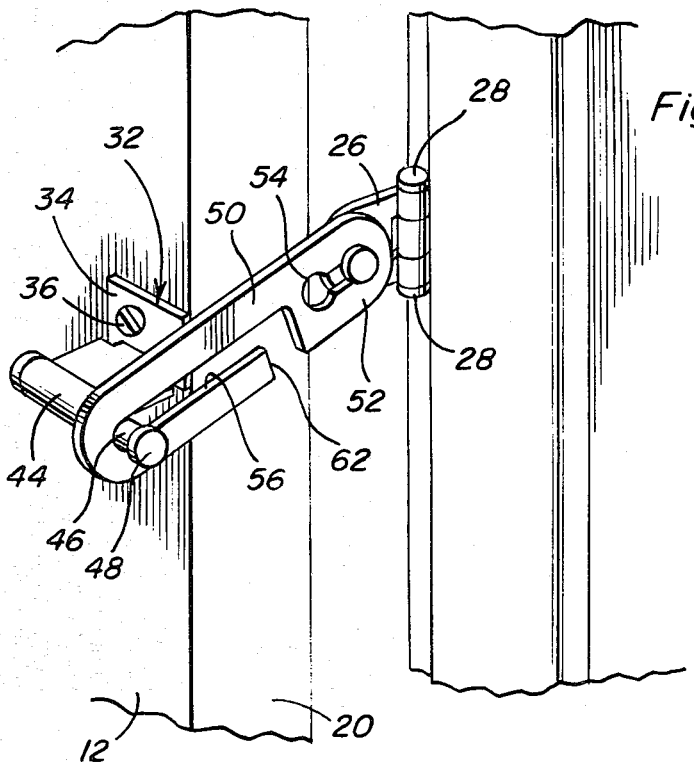
Fig. 4
Fig. 6
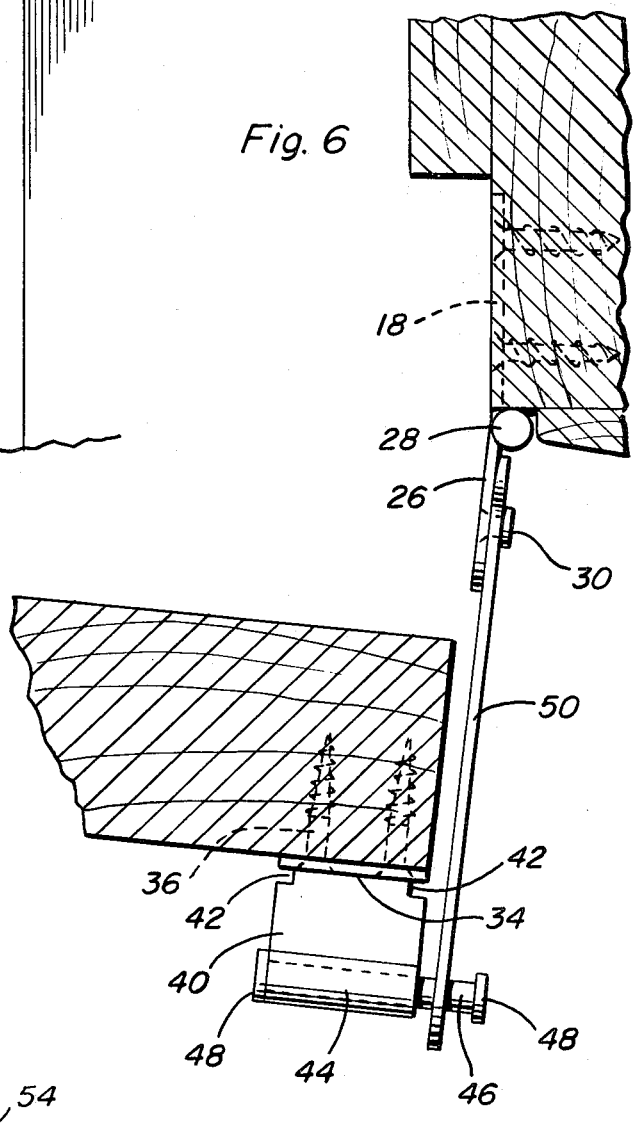
Fig. 5
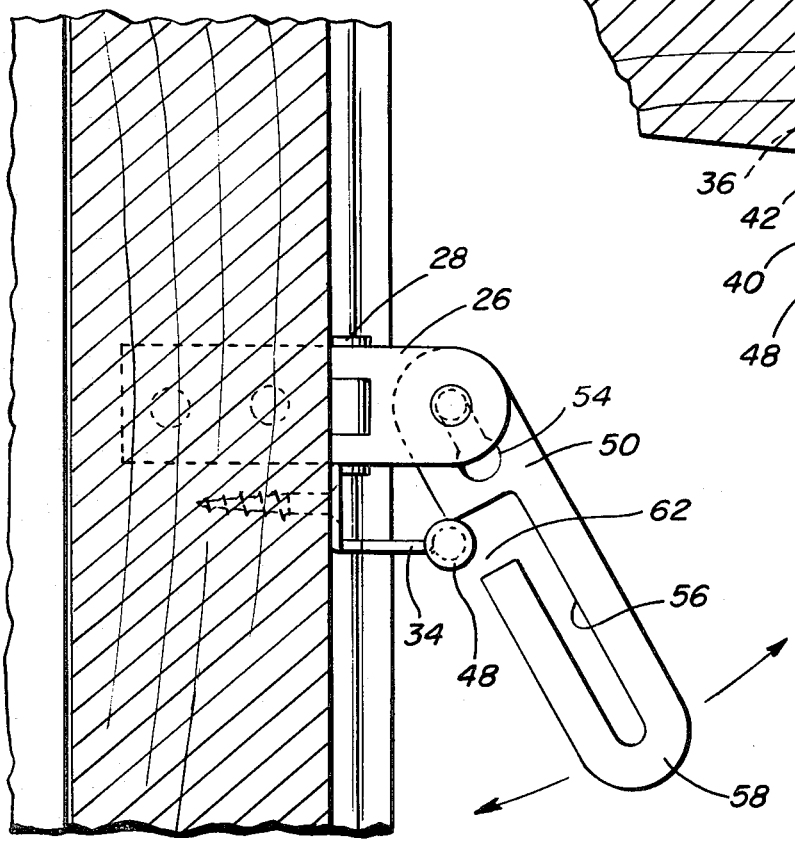

SAFETY DOOR LOCK

BACKGROUND OF THE INVENTION

Various forms of safety door locks heretofore have been provided and include structure operable not only to lock the associated door in the closed position, but also operable to allow slight movement of the associated door toward the open position and to prevent further movement of the door to the open position. However, these previously known forms of locks, for the most part, are designed to be face mounted on a door free swinging edge and an adjacent door frame portion and they are more complex in structure than necessary. Accordingly, a need exists for a safey door lock which may be more securely mounted relative to a door frame or jamb and which includes substantial components thereof comprising no more than simply formed strap metal material.

Examples of various previously known forms of safey door locks including some of the general structural and operational features of the instant invention are disclosed in U.S. Pat. Nos. 179,308, 251,732, 252,993, 416,874, 806,545, 1,195,884, 1,722,355, 2,013,779 and 2,102,729.

BRIEF DESCRIPTION OF THE INVENTION

The safety door lock of the instant invention comprises a frame portion supported mounting flange from which a plate like mount is pivotally supported, the mounting flange and mount comprising little more than the hinge leaves of a conventional hinge assembly. In addition, an elongated strap metal hasp has one end thereof pivotally supported from the mount for oscillation about an axis normal to the axis of oscillation of the mount relative to the jamb mounting flange and the other end portion of the hasp includes a slot formed therein with which a latch member supported from an adjacent free swinging door edge may be engaged whereby to enable the door to be partially opened, but prevented from being further opened. In addition, the hasp and support structure for the latch member include co-acting portions which are capable of functioning in a manner to lock the associated door in a closed position.

The main object of this invention is to provide a safey door lock which may be used in conjunction with a horizontally swingable door to enable the door to be swung to a slightly open position from a fully closed position and which will prevent further movement of the door toward a fully opened position.

Another object of this invention is to provide a safety door lock including door and jamb mounted components which may be readily engaged and disengaged with each other, as desired.

A still further object of this invention is to provide a safety door lock in accordance with the preceding objects and constructed in a manner which will enable the door lock to be reasonably readily released as a result of instruction to a young child by an adult from the outer side of the door.

Still another object of this invention is to provide a safety door lock constructed in a manner whereby it may be readily mounted in operative association with substantially all types of horizontally swingable doors.

A still further object of this invention is to provide a lock which will be readily actuatable by infirm persons as well as partially disabled persons.

A final object of this invention to be specifically enumerated herein is to provide a safety door lock in accordance with the preceding objects and which will conform to conventional form of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a fragmentary perspective view illustrating the manner in which the hasp of the lock may be engaged with the latch member thereof in order to prevent movement of the door past a slightly open position;

FIG. 5 is a fragmentary vertical sectional view illustrating the manner in which the hasp may be disengaged from and engaged with the latch member portion of the lock when the door is in the closed position;

FIG. 6 is a horizontal sectional view of the assemblage of component parts illustrated in FIG. 4;

DETAILED DESCRIPTION OF THE INVENTION

Figure 1:
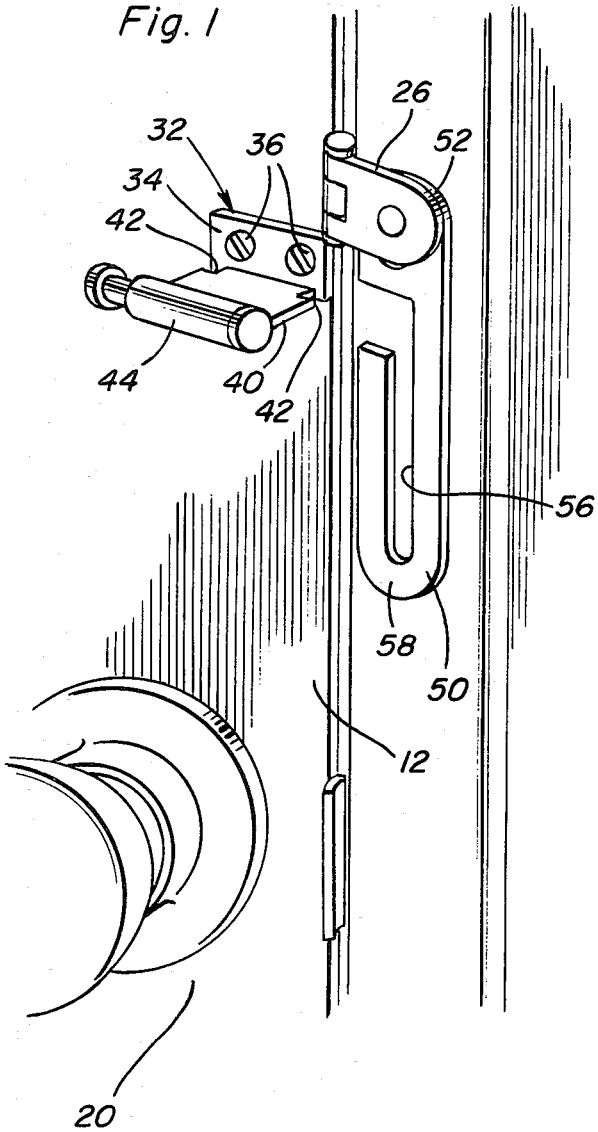
FIG. 1 is a fragmentary perspective view of the door lock of the instant invention in operative association with a door jamb portion and the adjacent free swinging edge portion of a door.
Figure 2:
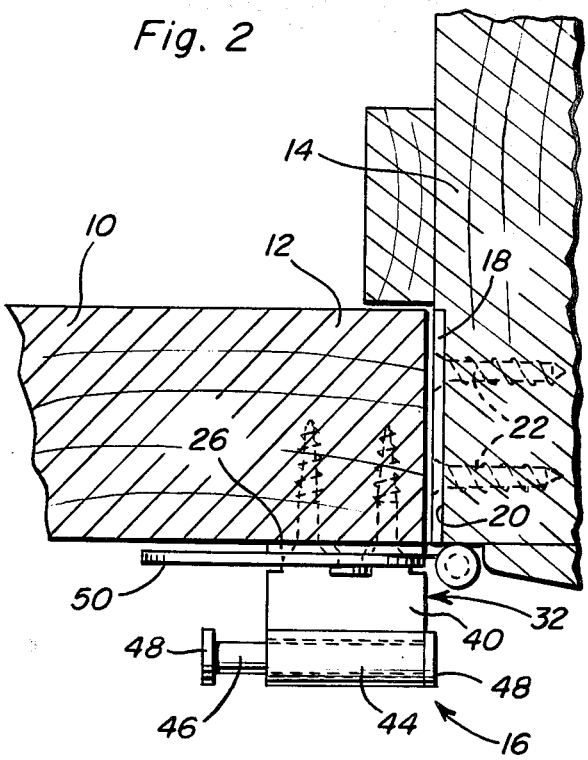
FIG. 2 is a horizontal sectional view of the structure shown in FIG. 1, but with the pivoted mount and hasp portions of the lock rotated to positions with the hasp engaged with the mount plate for the latch member to lock the associated door in a fully closed position.

Referring now more specifically to the drawings the numeral 10 designates a door having a free edge portion 12 movable toward and away from a jamb portion 14 relative to which the door 10 has been moved to a closed position in FIGS. 1 and 2.

The safety door lock of the instant invention is referred to in general by the reference numeral 16 and includes a mounting flange 18 secured to the edge 20 of the jamb portion 14 through the utilization of suitable fasteners such as screw nails 22. The mounting flange 18 has a mount plate 26 pivotally supported therefrom through the utilization of a barrel hinge construction 28. Accordingly, the mounting flange 18, the mounting plate 26 and the barrel hinge construction 28 comprise little more than a conventional leaf hinge construction. However, the mount plate 26 includes a headed pivot shank 30 supported therefrom for a purpose to be hereinafter more fully set forth.

A mount referred to in general by the reference numeral 32 is provided and mounted on the free swinging edge 12 of the door 10 and the mount 32 includes a first vertical flange 34 secured to the inner face of the door 10 through the utilization of screws 36. The mount 32 also includes a second horizontal flange 40 which projects horizontally and outwardly from the lower end of the vertical flange 34 and includes opposite side notches 42 formed therein immediately adjacent the vertical flange 34. The outer free edge of the horizontal flange 40 includes a horizontal transverse sleeve 44 supported therefrom and a cylindrical latch member 46 of slightly greater length than the sleeve 44 is slidingly received therethrough and provided with opposite end diametrically enlarged heads 48 to prevent disengagement of the latch member 46 from the sleeve 44.

Also, an elongated strap-type hasp 50 is provided including a first end 52 having a keyhole opening 54 formed therein in which the pivot shank 30 is receivable to pivotally support the first end 52 of the hasp 50 from the mount plate 26 and the hasp 50 includes a longitudinal slot 56 formed therein closed at the second end 58 of the hasp 50 and opening laterally outwardly through one longitudinal side edge 60 of the hasp 50 as at 62.

Figure 3:
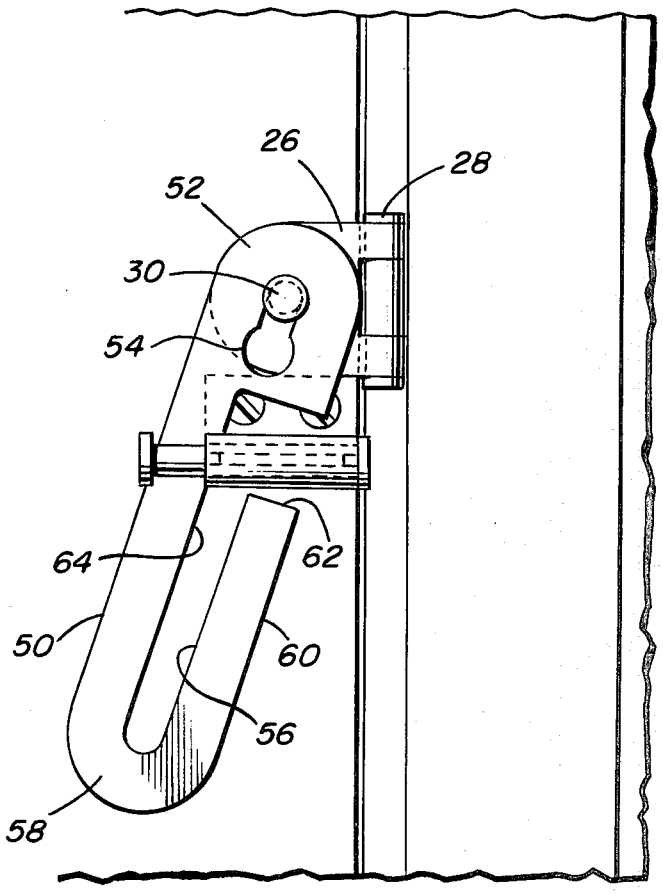
FIG. 3 is a fragmentary front elevational view of the assemblage of components illustrated in FIG. 2.

With attention now invited more specifically to FIGS. 1, 2, 4 and 6 of the drawings, it may be seen that the mount portion or plate 26 may be swung from one extreme position such as that illustrated in FIG. 1 of the drawings, past an intermediate position substantially aligned with the mounting flange 18 and illustrated in FIGS. 4 and 6 of the drawings and the opposite extreme position illustrated in FIG. 2 of the drawings with the mount plate 26 disposed immediately above the vertical flange 34 of the mount 32 and arranged substantially co-planar therewith. When the door 10 is in the closed position and the mount plate 26 is in the extreme position thereof illustrated in FIG. 2, the hasp 50 may be positioned as illustrated in FIG. 3 of the drawings with the edge 64 of the hasp 50 engaged in the notch 42 disposed furtherest from the free swinging edge of the door 10. When thus arranged, the safety door lock 16 locks the door 10 against movement from the closed position thereof toward an even partially opened position.

On the other hand, when the door lock 16 is not to be used, the mounting plate 26 and hasp 50 may be arranged in the out of the way positions thereof illustrated in FIG. 1. However, if it is desired to use the lock 16 in order to enable partial opening of the door 10, the latch member 46 may be shifted to the right from the position thereof illustrated in FIG. 1 in order to extend the right end of the latch member 46, see FIG. 6. Thereafter, the mount plate 26 may be swung from the out of the way position of FIG. 1 toward the extended position thereof illustrated in FIG. 5 and the lower end of the hasp 50 may be swung inwardly to hang vertically such that the latch member 46 will be received in the slot 56 in the manner illustrated in FIG. 5. As the door is opened the latch member 46 will slide in the slot 56 as shown in FIG. 4. The keyhole opening 54 in the hasp 50 enables a slight shifting of the hasp 50 relative to the latch member 46 as may be required and provides a means of dismounting hasp 50 from pivot shank 30 so that hasp 50 may be reversed when the device is mounted on a right-hung door as opposed to the left-hung door illustrated.

After the hasp 50 has been positioned as illustrated in FIG. 5 of the drawings, as the door 10 is opened the latch member 46 will move inwardly of the slot 56 and down to the closed end thereof in the manner illustrated in FIG. 4 to prevent further opening of the door 10. Of course, the hasp may not be disengaged from the latch member 46 until the door is moved to a substantially fully closed position, the head 48 of the latch member 46 not being receivable through the slot 56.

Thus, it may be seen that the lock 16 may be used in the manner illustrated in FIG. 4 of the drawings to prevent movement of the door 10 toward a fully opened position from, but a slightly open position, and that the latch 16 may also be used in the manner illustrated in FIGS. 2 and 3 of the drawings to prevent movement of the door toward an open position from the fully closed position thereof.

Also, other than the sleeve 44, the latch member 46, the pivot shank 30 and the barrel hinge construction 28, all of the components of the lock 16 may be readily formed of strong strap material.

Figure 7:
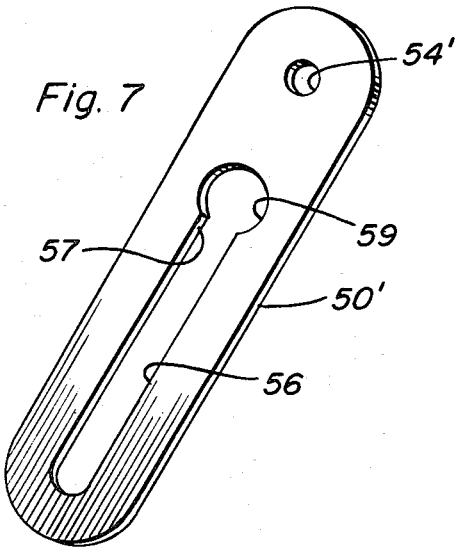
FIG. 7 is a perspective view of a modified form of hasp.

With attention directed to FIG. 7 there may be seen a modified form of hasp 50' wherein the opening 54' thereof is round and may receive the headed pivot shank 30 therethrough. The hasp 50' includes a slot 56' corresponding to the slot 56, but which does not open laterally through the longitudinal side edge 60'. Rather, the end 57 of the slot 56' is enlarged at 59 to receive the head 48 of the latch member 46 therethrough. Accordingly, the latch member 46 may be engaged in the slot 56' while the door 12 is fully closed and in a manner that will reduce the possibility of a young child releasing the hasp 50' when such release is not desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a vertical frame portion and an associated horizontally swingable closure member including a free edge portion swingable toward and away from the frame portion to close and open the closure member, respectively, a frame plate stationarily supported from said frame portion and a latch element stationarily supported from said closure member and including a latch portion projecting slightly outward from said free edge portion, a mount plate pivotally supported from said frame plate for oscillation relative thereto about a first axis paralleling said free edge portion, an elongated hasp pivotally supported at one end from said mount plate for oscillation about a second axis generally normal to said first axis, said hasp including a longitudinal slot formed therein, the end of said slot remote from the other end of said hasp including entrance means through which said latch portion is receivable into the adjacent end of said slot, said latch portion being slidable in and longitudinally of said slot, said latch portion of said latch element being supported from said closure member for extension and retraction relative to said free edge portion.

2. The combination of claim 1 wherein said latch portion includes an enlarged outer end head of a size too great to be received laterally through said slot.

3. The combination of claim 1 wherein said latch element includes a notched portion thereof closely adjacent the side of said closure member which is advanced during swinging movement of said closure member to the open position and in which notched portion an edge portion of said hasp is receivable, when the hasp and mount plate closely overlies said side of said closure member, to latch said closure member against swinging from the closed position thereof toward an open position.

4. In combination with a vertical frame portion and an associated horizontally swingable closure member including a free edge portion swingable toward and away from the frame portion to close and open the closure member, respectively, a frame plate stationarily supported from said frame portion and a latch element stationarily supported from said closure member and including a latch portion projecting slightly outward from said free edge portion, a mount plate pivotally supported from said frame plate for oscillation relative thereto about a first axis paralleling said free edge portion, an elongated hasp pivotally supported at one end from said mount plate for oscillation about a second axis generally normal to said first axis, said hasp including a longitudinal slot formed therein, the end of said slot remote from the other end of said hasp including entrance means through which said latch portion is receivable into the adjacent end of said slot, said latch portion being slidable in and longitudinally of said slot, said latch element including a notched portion thereof closely adjacent the side of said closure member which is advanced during swinging movement of said closure member to the open position, said mount plate being swingable relative to said frame plate about said first axis, when said closure member is in said closed position, to a position projecting horizontally across and closely opposing the margin of said one side of said closure member extending along said free edge portion and said hasp being swingable toward a position with the other end thereof inclined downwardly and with said notched portion received through said entrance means and the edge of said hasp defining the portion of said slot opposite said entrance means seated in said notched portion to latch said closure member against swinging from the closed position thereof toward an open position.

5. In combination with a vertical frame portion and an associated horizontally swingable closure member including a free edge portion swingable toward and away from the frame portion to close and open the closure member, respectively, a frame plate stationarily supported from said frame portion and a latch element stationarily supported from said closure member and including a latch portion projecting slightly outward from said free edge portion, a mount plate pivotally supported from said frame plate for oscillation relative thereto about a first axis paralleling said free edge portion, an elongated hasp pivotally supported at one end from said mount plate for oscillation about a second axis generally normal to said first axis, said hasp including a longitudinal slot formed therein, the end of said slot remote from the other end of said hasp including entrance means through which said latch portion is receivable into the adjacent end of said slot, said latch portion being slidable in and longitudinally of said slot, said hasp one end and said mount plate including co-acting means releasably oscillatably supporting said hasp from said mount plate.

6. The combination of claim 5 wherein said co-acting means include a laterally projecting headed pivot fastener carried by said mount plate and a keyhole slot formed in said one end of said hasp through which said pivot fastener projects.

7. In combination with a vertical frame portion and an associated horizontally swingable closure member including a free edge portion swingable toward and away from the frame portion to close and open the closure member, respectively, a frame plate stationarily supported from said frame portion and a latch element stationarily supported from said closure member and including a latch portion projecting slightly outward from said free edge portion, a mount plate pivotally supported from said frame plate for oscillation relative thereto about a first axis paralleling said free edge portion, an elongated hasp pivotally supported at one end from said mount plate for oscillation about a second axis generally normal to said first axis, said hasp including a longitudinal slot formed therein, the end of said slot remote from the other end of said hasp including entrance means through which said latch portion is receivable into the adjacent end of said slot, said latch portion being slidable in and longitudinally of said slot, said latch portion including an enlarged outer end head of a size too great to be received laterally through said slot, said latch element including a notched portion thereof closely adjacent the side of said closure member which is advanced during swinging movement of said closure member to the open position and in which notched portion an edge portion of said hasp is receivable, when the hasp and mount plate closely overlies said side of said closure member, to latch said closure member against swinging from the closed position thereof toward an open position, said hasp one end and said mount plate including co-acting means releasably oscillatably supporting said hasp from said mount plate.

8. The combination of claim 1 wherein said entrance means includes a transversely enlarged portion of said slot adjacent said one end of said hasp.

* * * * *